United States Patent [19]

Sturkey

[11] 4,340,986

[45] Jul. 27, 1982

[54] METHOD FOR WET PROCESSING OF TEXTILE MATERIAL IN ENDLESS ROPE FORM

[75] Inventor: William C. Sturkey, Charlotte, N.C.

[73] Assignee: Gaston County Dyeing Machine Company, Mount Holly, N.C.

[21] Appl. No.: 316,229

[22] Filed: Oct. 29, 1981

Related U.S. Application Data

[62] Division of Ser. No. 169,145, Jul. 15, 1980, Pat. No. 4,318,286.

[51] Int. Cl.[3] ..... D06B 3/28

[52] U.S. Cl. ..... 8/152

[58] Field of Search ..... 8/152; 68/177, 178

[56] References Cited

U.S. PATENT DOCUMENTS

| | | | |
|---|---|---|---|
| 3,016,728 | 1/1962 | Mann et al. | 68/177 |
| 3,656,325 | 4/1972 | Peter | 68/177 X |
| 3,952,558 | 4/1976 | Sandberg et al. | 68/177 |

FOREIGN PATENT DOCUMENTS

| | | | |
|---|---|---|---|
| 152071 | 6/1953 | Australia | 8/152 |
| 847 | of 1852 | United Kingdom | 68/177 |

*Primary Examiner*—Philip R. Coe

*Attorney, Agent, or Firm*—Richards, Shefte & Pinckney

[57] ABSTRACT

An improved method and apparatus for wet processing an endless rope of material wherein a modified J-box arrangement is provided for storing an accumulation of rope in a treating bath and a combined overflow chamber and liquid jet assembly is provided for circulating the rope to and from the bath in an entraining liquid stream. The storage arrangement includes a partially perforate outer wall and an imperforate partial inner wall spaced inwardly therefrom forming a confinement area therebetween for rope and liquid returning from the circulatory system. The confinement is sufficient to maintain therein a column of the returning liquid extending above the level of the bath whereby gravitational forces acting thereon hydraulically move the rope accumulation through the bath, the rope in the confinement being released to expand as it moves past the terminating end of the inner wall whereby movement of the rope through the bath is enhanced.

3 Claims, 2 Drawing Figures

METHOD FOR WET PROCESSING OF TEXTILE MATERIAL IN ENDLESS ROPE FORM

CROSS REFERENCE TO RELATED APPLICATIONS

This is a divisional application of U.S. patent application Ser. No. 169,145, filed July 15, 1980, and now U.S. Pat. No. 4,318,286.

BACKGROUND OF THE INVENTION

The present invention relates to methods for wet processing of textile material in endless rope form and, more particularly, relates to the type of such methods utilizing a vessel for containing a treating bath of processing liquid, a rope storage arrangement for transiently storing in the bath a plaited accumulation of a major portion of the rope, and a rope circulating unit for progressively withdrawing the rope from the plaited accumulation thereof and returning it to the plaited accumulation under the entraining influence of a moving cycled portion of the processing liquid.

Typical textile wet processing apparatus of the abovedescribed type are the so-called jet machines, such machines characteristically utilizing a jet nozzle in the rope circulating unit thereof to create a conveying stream of the cycled treating liquid, and usually employing a curved rope storage compartment, such as a J-box or a U-shaped chamber, for transiently storing the plaited accumulation of rope within the bath of treating liquid. Heretofore, such wet processing apparatus have been extensively and relatively successfully employed for a wide variety of wet treatment operations. However, such machines have presented problems in the wet processing of surface sensitive textile fabrics such as fabrics formed of relatively low twist spun yarns, fabrics formed of a loosely knit, stretchable construction, and certain plush or pile fabrics. Fabrics of this type are especially susceptible to various forms of surface degradation and it is not unusual for such machines to produce fabric wrinkling, fuzziness, excessive stretching, and, in pile fabrics, disoriented pile. Conventional wisdom has generally been that deleterious results of this type are primarily attributable to the relatively high impingement action on the fabric of the jetstream of cycled treating liquid emitted by the jet nozzle of the processing machine, and some degree of attention has been directed to the modification and/or improvement of the rope circulatory systems of such machines to solve these problems; see, e.g., Turner et al U.S. Pat. No. 4,114,407. Although it is additionally known that, during the operation of such machines, there exists a tendency of the plaited accumulation of the rope material being treated to become excessively compacted at the lowermost point of the rope storage compartment, sometime to a sufficient extent to inhibit rope movement through the storage compartment, little effort has been directed to the alleviation of this problem, and conventional rope storage compartments have remained substantially unchanged since the advent of jet-type processing apparatus.

It is believed that, to a significant degree, this compaction of the plaited rope accumulation is a contributing factor in causing many of the above-described problems presently being encountered in the wet processing of surface sensitive fabrics because of the excessive fabric-to-fabric friction in the compacted rope. Additionally, undue compaction of the plaited fabric in the storage compartment can result in the cloth becoming jammed to the extent that it will not move, so that operator assistance is required to clear the storage chamber.

It is therefore an object of the present invention to provide an improved rope storage arrangement for textile wet processing apparatus of the above-described type and an improved method of wet processing textile materials in rope form which will substantially eliminate compaction of the plaited rope accumulation in the storage arrangement. It is a more specific object of the present invention to provide a rope storage arrangement which offers less friction for the moving cloth and which will utilize the gravitational forces of the processing liquid acting on the plaited rope accumulation to assist in the movement of the plaited rope through the storage arrangement. The present invention also provides, in combination with this rope storage arrangement, a rope circulatory system particularly designed to assist the aforesaid rope storage compartment in reducing the deleterious effect on the rope of the moving cycled portion of processing liquid in which the rope is entrained and the friction imposed on the moving rope.

SUMMARY OF THE INVENTION

Briefly described, the method of the present invention is utilized in conjunction with a system that provides a treating bath of processing liquid, preferably a dyestuff formulation, and that circulates the rope being processed through the bath by transiently storing a plaited accumulation of a major portion of the rope in the bath along a curved path extending downwardly to a lowermost point within the treating bath and upwardly therefrom while progressively withdrawing the rope from the bath at one end of the curved path and returning it to the bath at the other end of the curved path under the entraining influence of a moving cycled portion of the processing liquid. The method provides a significant advance over prior arrangements of this basic type in partially confining the rope and the cycled portion of processing liquid along the curved path as they are returned to the treating bath and releasing the confinement of the rope at a location along the curved path upstream of the lowermost point thereof. The confinement extends downwardly and is sufficient to maintain a significant quantity of the cycled portion of processing liquid in columnar form extending substantially above the level of the treating bath whereby the gravitational forces generated thereby will assist in moving the rope through the bath. The releasing of the confinement permits the rope to expand as it reaches the lowermost point of the curved path and begins to progress upwardly along the curved path. In this manner, the combination of partially confining the rope and the cycled processing liquid to take advantage of gravitational forces and subsequent release thereof to permit expansion of the confinement at the lowermost point of the curved path effectively eliminates rope compaction and friction, and provides a hydraulic movement of the plaited accumulation of rope through the treating bath.

The partial confining of the rope and the cycled processing liquid is preferably further characterized by limiting the flow of liquid within the confinement to the treating bath while fully confining the rope during its downward movement into the treating bath to reduce the friction imposed on the cloth as it passes through the storage chamber. It is additionally preferred that the returning of the rope to the treating bath is effected by entraining the rope in and wetting the rope with a gravitational flow of a first cycled portion of the processing liquid, and thereafter entrainingly impelling the rope with a jet of a second cycled portion of the processing liquid, and then directing the rope and the combined flow of the first and second portions of processing liquid into the confinement whereby the amount of liquid flowing with cloth is increased to reduce friction.

The apparatus provided for wet processing rope form textile material according to the present invention is basically characterized by a vessel for containing a treating bath of processing liquid, a rope storage arrangement for transiently storing in the treating bath a plaited accumulation of a major portion of the rope, and a unit for circulating the rope through the treating bath by progressively withdrawing the rope from the plaited accumulation at one location and returning it to the treating bath at another location under the entraining influence of a moving cycled portion of the processing liquid. The rope storage arrangement defines a curved rope path which extends downwardly from an inlet end at one side of the vessel to a lowermost point and upwardly therefrom to an outlet end at the other side of the vessel, the arrangement including a partially perforate outer wall which extends along the entire extent of the curved path and an imperforate inner wall extending in spaced relation to the outer wall along a portion of the curved path beginning adjacent the inlet end and terminating within the treating bath upstream of the lowermost point of the curved path.

In the preferred embodiment of the apparatus, the rope storage arrangement includes spaced side walls extending between the inner and outer walls to maintain the plaited accumulation of the rope between the inner and outer walls, the side walls extending with the outer wall beyond the terminating end of the inner wall to the outlet end of the curved rope path. To maintain the plaited accumulation between the side walls as it progresses past the terminating end of the inner wall, each side wall includes a perforated fabric dam inwardly adjacent the terminating end of the inner wall. Further, the outer wall includes an imperforate area adjacent the inlet end of the curved rope path to prevent the passage therethrough of the return flow of the entraining cycled portion of the processing liquid and to direct it between the inner and outer walls. Following the imperforate area along the curved rope path is a fully perforate area of the outer wall for reducing the passage or flow of cycled processing liquid to the treating bath, a second imperforate area following the fully perforated area and terminating upstream of the lowermost point of the curved rope path. A partially perforate area having a row of perforations extending along opposite sides of the outer wall follows the second imperforate area and extends therefrom past the lowermost point for limiting the flow of treating liquid from the storage chamber to the treating bath. A second fully perforated area follows the partially perforated area and terminates downstream of the outlet end of the curved rope path, a third imperforate area being adjacent the outlet end.

It is also preferred that the circulatory system of the apparatus include a driven reel about which the rope is trained for withdrawing the rope from the plaited accumulation, the reel being arranged such that the rope is trained approximately one hundred eighty degrees thereabout to prevent slippage of the rope on the reel. The circulatory system further includes an overflow chamber arrangement into and through which is cycled a portion of the processing liquid for gravitational overflowing discharge thereof onto the rope for wetting thereof, the overflow arrangement being followed downstream thereof by an arrangement for separately cycling another portion of the processing liquid through a jet nozzle and impellingly entraining the rope therewith. The combined flow of the portions of processing liquid from the jet nozzle and the overflow arrangement passes with the rope into a cloth tube extending from the discharge end of the jet nozzle, the combined flow and the rope being directed thereby into the inlet end of the curved rope path. The cloth tube is preferably inclined upwardly to an outlet located at a level at least as high as the discharge end of the jet nozzle to insure flooding thereof by the combined flow of the portions of processing liquid and to maintain full wetting of the rope until discharge from the cloth tube.

DESCRIPTION OF THE PREFERRED EMBODIMENT

Figure 1:
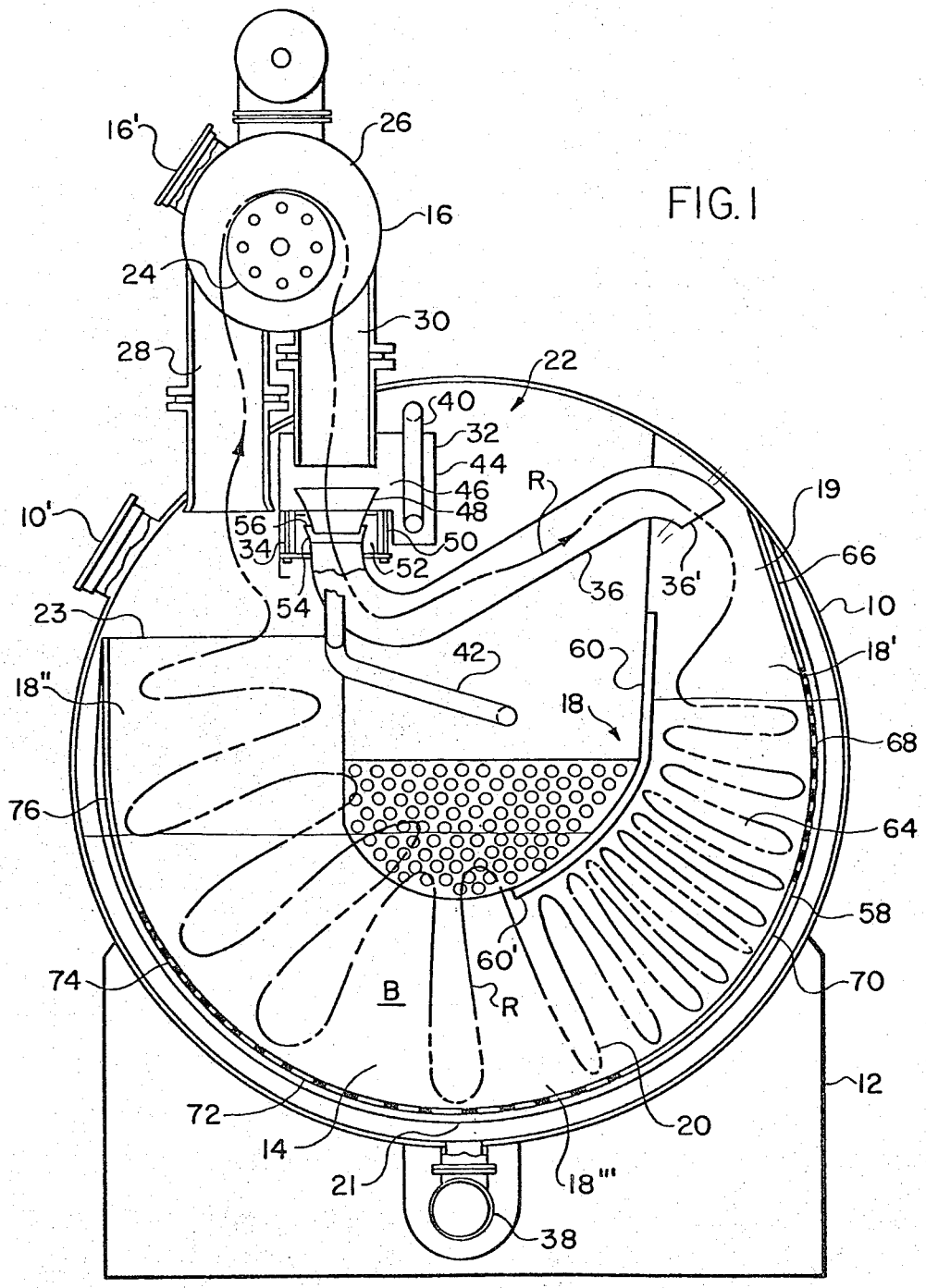
FIG. 1 is a diagrammatic illustration of the internal structure of apparatus for wet processing textile material in accordance with the present invention.
Figure 2:
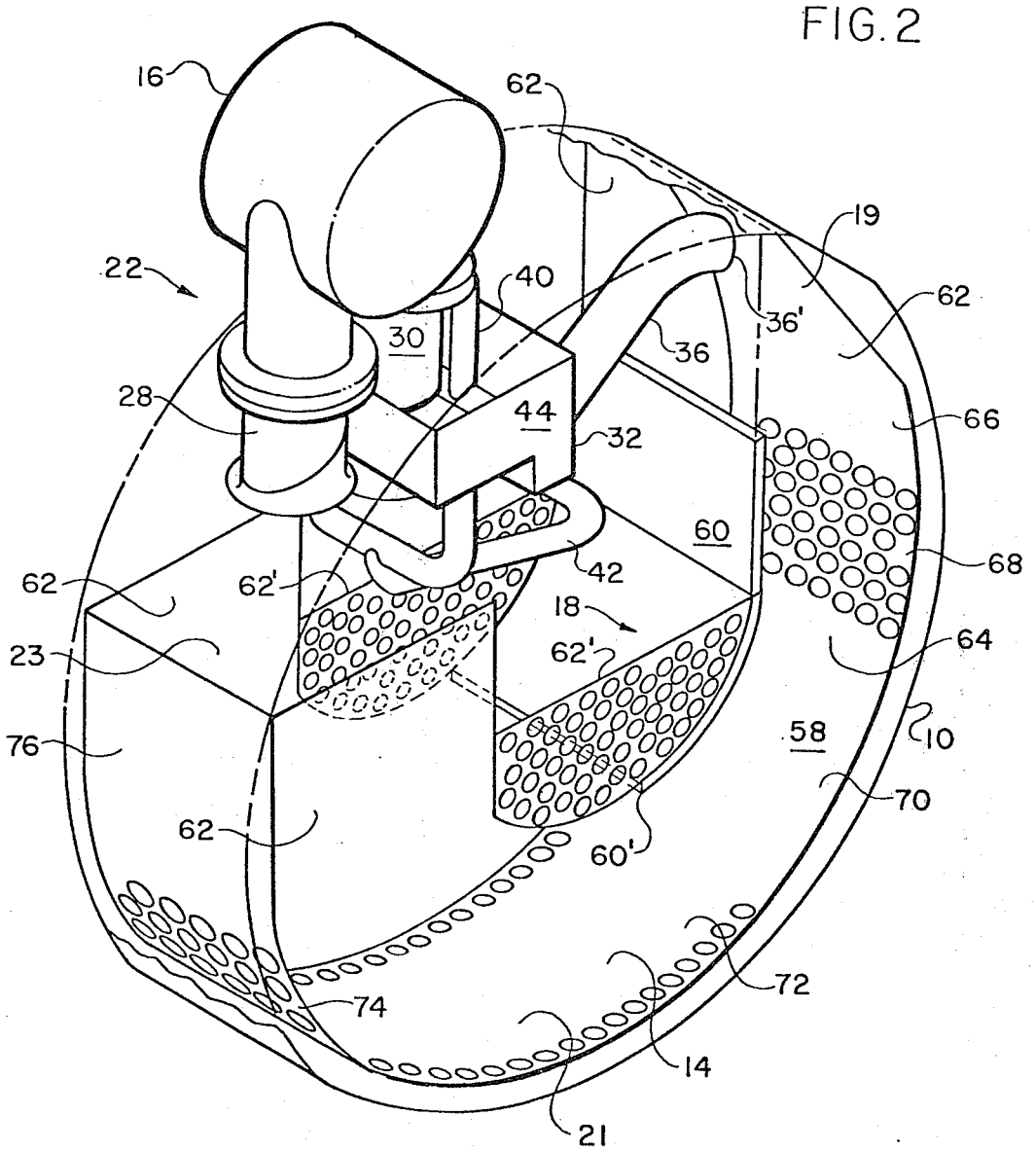
FIG. 2 is a diagrammatic perspective view of the apparatus of FIG. 1.

Referring now in greater detail to the accompanying drawings, the representative wet processing apparatus of FIGS. 1 and 2 comprises a cylindrical pressure vessel or kier 10 mounted with its axis horizontal on a suitable base 12 to provide therein a fabric treatment chamber 14 for containing a treating bath B of a processing liquid such as a dyestuff formulation, and an external superstructure 16 fitted on the vessel 10 for recirculation therethrough of textile material in endless rope form, indicated at R in FIG. 1. Both the vessel 10 and the superstructure 16 are provided with loading ports, 10' and 16' respectively, through either of which textile material may be introduced in conventional manner for processing and removed after processing.

Interiorly, the vessel 10 is provided with a rope storage arrangement, indicated generally at 18, extending through the lower portion of the vessel 10 and through the treating bath B for transiently storing in the treating bath B a plaited accumulation 20 of a major portion of the rope R. The rope storage arrangement 18 is basically of a conventional J-shaped or J-box configuration having two legs 18', 18'' respectively extending upwardly at opposite sides of the vessel 10 from a lower elbow portion 18''' disposed in the treating bath B, thereby defining a curved rope path extending downwardly from an inlet end 19 at the upper end of leg 18' to a lowermost point 21 in the elbow portion 18''' and upwardly therefrom to an outlet end 23 at the upper end of the leg 18''. A rope circulatory system, indicated generally at 22, is housed partially in the superstructure 16 and partially in the upper portion of the vessel 10 and extends from above the outlet end 23 of the rope storage arrangement 18 to above the inlet end 19 of the rope storage arrangement 18 for circulating the textile rope material R through the treating bath B by progressively withdrawing the rope R from the plaited accumulation 20 in leg 18'' of the rope storage arrangement 18 and returning it as a plaited accumulation 20 in the leg 18' of the rope storage arrangement 18.

As is best seen in FIG. 1, the superstructure 16 includes vertical intake and discharge legs 28, 30, respectively extending downwardly from a junction 26, the intake leg 28 being disposed directly above the outlet end 23 of the rope storage arrangement 18.

The rope circulatory system 22 basically comprises a driven lifter reel 24 rotatably journaled in the junction 26 between the vertical intake and discharge legs 28, 30, a gravitational overflow arrangement 32 fitted to the terminating end of the discharge leg 30, a fluid jet assembly 34 mounted on the lower, discharge side of the overflow arrangement 32, and a cloth return tube 36 extending from the discharge side of the jet assembly 34 to an outlet 36' directly above the inlet end 19 of the rope storage arrangement 18. Both the overflow arrangement 32 and the jet assembly 34 are arranged for receiving and discharging respective cycled portions of the processing liquid from the treating bath B withdrawn by a conventional pump arrangement (not shown) through a piping connection 38 at the bottom of the vessel 10, Processing liquid withdrawn from the bath B through the piping connection 38 is separated into two portions (not shown) and the two portions are conveyed through pipes 40 and 42, respectively, into the overflow arrangement 32 and the jet assembly 34. The overflow arrangement 32 comprises a housing 44 defining an overflow chamber 46 into which the pipe 40 extends and directs one of the cycled portions of the processing liquid. A funnel 48 extends upwardly into the overflow chamber 46 through the bottom wall thereof, the chamber 46 thereby being capable of containing between the funnel 48 and side walls of the housing 44 a quantity of processing liquid up to the level of the upper edge of the funnel 48, the processing liquid cycled into the chamber 48 in excess of such quantity gravitationally flowing over the upper edge of the funnel 48, through the jet assembly 34 therebelow and into the cloth tube 36 for return to the rope storage arrangement 18 in the treating bath B. The jet assembly 34 comprises a smaller housing 50 affixed to the bottom wall of the overflow housing 44 and surrounding the funnel 48, the jet housing 50 defining a jet chamber 52 into which the pipe 42 extends and conveys the other cycled portion of processing liquid. Interiorly, the jet housing 50 is provided with a vertically extending, frusto-conically shaped tube 54 disposed coaxially about the lower extension of the overflow funnel 48 to define an annular gap 56 therebetween of reducing cross-sectional area, thereby forming in the jet chamber 52 a jet nozzle. As will be understood, processing liquid cycled into the jet chamber 52 will overflow the upper edge of the tube 54 into the annular gap 56, the relatively narrow annular gap 56 restricting the free flow of the liquid therethrough whereby the liquid pressure in the jet chamber 52 will increase and the processing liquid flowing into the gap 56 will be emitted downwardly therefrom as a moving annular jetstream of processing liquid. The cloth return tube 36 is fitted to and extends from the lower end of the jet assembly tube 54 for receiving the overflowing liquid from the overflow chamber 46 and the annular jetstream of liquid from the jet assembly 34, the cloth tube 36 being inclined upwardly to its outlet 36' at a level at least as high as the discharge end of the jet assembly 34 whereby the combined flow of liquid from the overflow arrangement 32 and the jet assembly 34 is transiently contained in and substantially floods the tube 36 as it flows therethrough and overflows the discharge end 36' thereof. This flooding aids the flow of the rope through the tube 36 by reducing friction thereon.

As will be understood, the textile rope material R is most advantageously introduced in a conventional manner into the apparatus of FIGS. 1 and 2 through port 16' by actuating the lifter reel 24 and actuating the aforementioned pump to begin the cycling of a portion of the treating bath into and through the overflow arrangement 32 and jet assembly 34 of the circulatory system 22, and then directing an end of a length of textile material to be processed through the port 16', over the lifter reel 24 and into the superstructure discharge leg 30 of the superstructure 16 to present the end of the material to the liquid overflow and jet unit, the reel 24 directing the fabric into the discharge leg 30 and the combined liquid output of the overflow and jet unit entraining and drawing the fabric through the overflow funnel 48 and the jet tube 54 and conveying it through the cloth tube 36 and into the inlet end 19 of the rope storage arrangement 18 where it accumulates in plaits. The port 10' may then be used to obtain access to the vessel interior to fish from the elbow portion 18''' of the rope storage arrangement 18 the leading end of the material initially fed for sewing thereof to the trailing end of the material to form an endless length or rope of the textile material for processing.

The normal processing operation of the apparatus of FIGS. 1 and 2 may then be accomplished, the driven lifter reel 24 being operative to progressively withdraw vertically through the superstructure intake leg 28 the textile rope material R from the plaited accumulation thereof in the leg 18'' of the rope storage arrangement 18 and to present the withdrawn rope R to the overflow arrangement 32 and jet assembly 34 by directing it vertically downwardly thereto through the superstructure discharge leg 30. The gravitational overflow of cycled processing liquid from the overflow chamber 46 initially entrains and wets the withdrawn rope material R, and the annular jetstream output of processing liquid from the jet chamber 52 immediately thereafter impellingly entrains the rope R to convey it into and through the cloth tube 36 and deposit it in the leg 18' of the rope storage arrangement 18. To advantageously facilitate the handling of surface sensitive fabrics, the lifter reel 24 is of a relatively small diameter in relation to the size of the superstructure legs 28, 30 and junction 26 to minimize the possibility of frictional contact between the moving fabric rope R and the inner surfaces of the superstructure 16, but the lifter reel has sufficient purchase on the fabric rope R because it is trained about the reel 24 approximately one hundred eighty degrees (180°) to reduce the likelihood of fabric slippage thereon. The tubular components of the circulatory system 22 through which the rope R travels are substantially larger in cross-sectional area than the rope material R to allow free passage through the circulatory system 22 with minimal frictional contact between the fabric and the structural elements of the circulatory system 22. Moreover, the thorough wetting of the rope by the overflow arrangement 32 upstream of the jet 34 protects the surface of the rope material R from the deleterious effects of the high impingement velocity of the jet nozzle which has caused problems in the wet treatment of surface sensitive fabrics with conventional machines, as discussed hereinabove. Additionally, the volume of processing liquid overflowing from the overflow chamber 46 is sufficiently greater than is necessary to fully wet the rope R so that the excessive overflowing liquid effectively submerges the jet assembly 34 and shields the rope R from the jetstream of processing liquid emitted from the gap, further reducing the impact thereof on the rope material R. The transient retention by the cloth tube 36 of the combined processing liquid output of the overflow arrangement 32 and the jet assembly 34 in a manner producing flooding of the cloth tube 36 provides for submergence of the rope material throughout the length of the cloth tube 36 thereby maintaining continued thorough wetting of the rope material R until its discharge from the cloth tube 36. It can therefore be seen that the circulatory system 22 of the present apparatus is particularly arranged to achieve a maximum interaction between the rope R and the processing liquid during the withdrawal of the rope from the plaited accumulation 20 and its conveyance through the circulatory system 22 while minimizing the deleterious effects on the surface of the rope R caused by this handling of the rope.

As can best be seen in FIG. 2, the rope storage arrangement 18 basically comprises a curved, partially perforate outer wall 58, an imperforate inner wall 60 spaced inwardly of the outerwall 58, and two spaced side walls 62 extending between the outer and inner walls 58, 60, respectively, and extending with the outer wall 58 substantially the length thereof. The two ends of the outer wall 58 respectively adjoin the inner side of the cylindrical wall of the vessel 10 adjacent the outlet 36' of the cloth tube 36 and the intake leg 28 of the superstructure 16, the outer wall 58 extending therebetween through the treating bath B at a slight inward spacing from the cylindrical wall of the vessel 10 to support the plaited accumulation 20 of the rope R in the treating bath B and guide its movement therethrough along the aforementioned curved rope path. The imperforate inner wall 60 extends downwardly at an inward spacing from the outer wall 58 from a point adjacent to and below the outlet 36' of the cloth tube 36 and then into the treating bath B, and terminates therein at 60' upstream of the lowermost point 21 of the curved rope path, the inner wall 60 thereby defining with the outer wall 58 a confinement area 64, discussed more fully hereinafter, in which the rope R and the combined flow of processing liquid from the overflow arrangement 32 and the jet assembly 34 are transiently contained upon their return to the treating bath B through the cloth tube 36. The two side walls 62 are substantially imperforate, except as discussed hereinafter, and extend with the outer wall 58 the length thereof to maintain the plaited accumulation 20 of rope R between the outer and inner walls 58, 60.

As discussed hereinbefore, conventional rope storage arrangements of the J-box or similar curved type normally provide substantially fully perforated inner and outer walls each of which extends the full length of the storage arrangement. While such conventional arrangements provide for generally unrestricted communication and interaction between the plaited accumulation of rope and the treating bath, the rope storage compartment defined between the inner and outer walls restricts the expansion or fulling of the plaited rope. Moreover, there is a tendency for the plaited rope to accumulate at the lowermost point of the compartment, the restrictive inner and outer walls at this point causing compaction of this accumulation and excessive fabric to fabric friction therein which at best may cause wrinkling or other surface damage to the rope and at worst may result in a blocking of the compartment. The partially perforated nature of the outer wall 58 and the imperforate nature and partial extent of the inner wall 60 of the present apparatus significantly reduce these problems by providing a gravitationally-induced, hydraulic conveyance of the plaited accumulation 20 of rope R through the treating bath B, and by releasing the plaited accumulation at the point where jamming thereof is most likely to occur.

As can best be seen in FIG. 1, the outer wall 58 is provided with an imperforate area 66 at the end thereof adjacent the outlet 36' of the cloth tube 36 to prevent passage therethrough of the returning combined liquid flow of the overflow arrangement 32 and the jet assembly 34 and to direct such returning flow between the outer and inner walls 58, 60 and into the aforementioned confinement area 64. Following the imperforate area 66, the outer wall 58 is provided with a relatively small, fully perforated area 68 extending adjacent the upper portion of the confinement area 64 followed by a second imperforate area 70 extending adjacent the lower portion of the confinement area 64, thereby permitting in the confinement area limited communication between the returning rope R and liquid flow and the treating bath B. Accordingly, the returning rope R and the returning combined liquid flow from the overflow arrangement 32 and the jet assembly 34 are partially and transiently confined between the outer and inner walls 58, 60 in the leg 18' of the rope storage arrangement 18 sufficiently to maintain a significant portion of the returning processing liquid in the confinement area 64 in columnar form extending substantially above the level of the treating bath B and, in this manner, the gravitational forces generated by and acting on the confined rope and column of processing liquid create a movement of the confined rope R downwardly toward the lowermost point 21 to assist in moving the plaited accumulation 20 of rope R through the treating bath B. In operative conjunction with this hydraulic effect, the termination of the partial inner wall 60 at 60' provides a release of the confined rope R at a location along the curved rope path upstream of the lowermost point 21, permitting the plaits of the confined rope R to relax and expand as they reach the lowermost point 21 and facilitating relatively free upward movement thereof in the leg 18'' of the rope storage arrangement 18 thereby preventing the compaction of the rope R at the lowermost point 21 and the fabric-to-fabric friction associated therewith.

As can best be seen in FIG. 2, each side wall 62 includes a perforated fabric dam portion 62' extending between the legs 18' and 18'' inwardly adjacent the terminating end 60' of the inner wall 60 to maintain the expanding plaits of the plaited accumulation 20 of rope R between the side walls 62 as they progress past the terminating end 60' and thereby prevent their falling over the side walls 62 as they expand and relax. To facilitate interaction and communication between the processing liquid in the treating bath B and the accumulation of rope R in the rope storage arrangement 18, the remainder of the outer wall 58 following the aforementioned second imperforate area 70 thereof is substantially perforated. The outer wall 58 is thus provided with partially perforate area 72 which extends from the second imperforate area 70 past the lowermost point 21 of the rope storage arrangement 18, the partially perforate area 72 being provided with a single row of perforations extending along opposite sides of the outer wall 58 with the central portion of the area 72 being imperforate to prevent the aforediscussed application of suction through the piping connection 38 for withdrawing processing liquid from the bath B from affecting the plaited accumulation 20. A second fully perforate area 74 of the outer wall 58 follows the partially perforate area 72 and terminates downstream of the outlet end 23 of the rope storage arrangement 18, the outer wall 58 being a third imperforate area 76 at the outlet end 23.

By virtue of the foregoing arrangement, a number of significant advantages are obtained in the wet processing of textile fabrics, particularly surface sensitive fabrics which are susceptible to surface degradation when they encounter substantial amounts of friction during processing. It will be noted that the rope R is thoroughly wetted by the overflow arrangement 32 prior to its being exposed to the forces of the jet assembly 34, and the cloth tube 36 is completely flooded with processing liquid as the rope R passes therethrough, thereby providing the rope R with a protective covering of a treating liquid as it passes through the jet assembly 34 and the cloth tube 36 to reduce friction and surface degradation of the cloth resulting therefrom. Moreover, the increased column of treating liquid flowing with the rope R as it moves in the inlet leg 18' of the rope storage arrangement 18 similarly reduces friction as the rope moves along the surface of the upper portion of the leg 18' which is above the level of the bath B and therefore relatively dry as compared with the portion of the rope storage arrangement within the bath.

This same increased column of treating liquid is also effectively used to move the rope R through the rope storage arrangement 18 because, as described above, the unique construction of the rope storage arrangement limits the egress of the treating liquid from the leg 18' to the bath B so that a significant portion of this treating liquid is maintained in the leg 18' in columnar form extending above the level of the path B so as to provide a gravitation force that is imparted to the plaited accumulation 20 of the rope R to move it through the rope storage arrangement 18. In this regard, it should be realized that the extent of the accumulation of the treating liquid in the leg 18' will vary during the wet treating process because the escape of such from the leg 18' will not be uniform. More particularly, the movement of the plaited accumulation across the perforations in the area 68 of the outer storage chamber wall 58 will cover and uncover varying numbers of the perforations to thereby vary the open area through which the partially confined treating liquid can pass from the leg 18' and the generally inconsistent pattern of the plaited accumulation 20 will vary the downward flow of the partially confined treating liquid therethrough toward the level of the bath B. Nevertheless, even though the extent of the retained treating liquid in the portion of leg 18' above the path B will vary to some extent during the continuing operation of the apparatus, this retained treating liquid will impose the aforesaid gravitational assist to the plaited accumulation 20 as it moves through the rope storage arrangement 18.

Moreover, cloth movement through the rope storage arrangement 18 is assisted by the unique partial inner wall 60 because the plaited accumulation is free to expand at the point in the rope storage arrangement 18 where the potential for clogging of the cloth is the greatest, namely at the lowermost point in the curved path of movement defined by the rope storage arrangement. Thus, not only does the partial inner wall 60 reduce significantly the possibility of clogging that could require operator assistance to free the cloth, it reduces fabric-to-fabric and fabric-to-wall friction which could cause surface degration while also permitting the aforesaid gravitational forces imposed on the plaited accumulation in the leg 18' to be used to maximum advantage in assisting the movement of the cloth through the rope storage chamber 18.

While ease of movement of the cloth through the storage chamber 18 is, in and of itself, a significant advantage, the extent to which such movement is improved by the present invention provides an additional significant advantage. More specifically, in conventional rope storage chambers the resistance to cloth movement therethrough generally results in the level of the plaited accumulation being high at the inlet end of the cloth storage chamber and low at the outlet end, thereof where it is lifted from the bath by the lifter reel. This result has two disadvantages. First, the low position of the plaited accumulation at the outlet end requires a greater lifting force by the lifter reel since the cloth must be raised a greater distance, and also because the cloth being lifted comes directly from the bath so that it is heavy with treating liquid. Secondly, the cloth storage chamber is not filled to capacity with the plaited accumulation of cloth because of the empty portion of the cloth storage chamber at the outlet end thereof.

By contrast, the less restricted movement of the cloth through the cloth storage arrangement 18 of the present invention results in the body of the plaited accumulation 20, as a whole, shifting toward the outlet end of cloth storage arrangement 18. Therefore, the plaited accumulation 20 is disposed at a higher level in the leg 18'' so as to be closer to the lifter reel, thereby reducing the lifting force required therefrom, and there is provided an unfilled area in leg 18' which can be utilized to load a greater amount of cloth in the wet treating apparatus for effective processing. For example, it has been found that with certain fabrics, the cloth capacity of a jet machine can be increased, in a typical machine, from approximately two hundred and fifty pounds to approximately three hundred and forty pounds without adversely affecting the results of the wet processing and without significantly increasing the time of an operating cycle.

Thus, the present invention provides an unique arrangement which reduces friction and the surface degradation that may be associated therewith, while substantially improving the movement of the cloth through the machine and increasing the operating capacity of the machine.

The present invention has been described in detail above for purposes of illustration only and is not intended to be limited by this description or otherwise to exclude any variation or equivalent arrangement that would be apparent from, or reasonably suggested by the foregoing disclose to the skill of the art.

I claim:

1. A method of wet processing textile material in endless rope form comprising the steps of:

(a) providing a treating bath of processing liquid;

(b) circulating the rope through said treating bath of processing liquid by transiently storing a plaited accumulation of a major portion of the rope in said treating bath along a curved path extending downwardly to a lowermost point within said treating bath and upwardly therefrom while progressively withdrawing the rope from said treating bath at one end of said curved path and returning it to said treating bath at the other end of said curved path under the entraining influence of a moving cycled portion of said processing liquid;

(c) partially confining the rope and said portion of said processing liquid along said curved path as they are returned to said treating bath, the confinement extending downwardly into said treating bath and being sufficient to maintain a significant quantity of said portion of said processing liquid in columnar form extending substantially above the level of the treating bath whereby the gravitational forces generated thereby will assist in moving the rope into and through said treating bath; and (d) releasing the confinement of the rope at a location along said curved path upstream of said lowermost point thereof whereby said plaited accumulation of the rope can expand as it reaches said lowermost point and begins to progress upwardly along said curved path.

2. A method of wet processing textile material as defined in claim 1 and further characterized in that said partially confining the rope and said portion of said processing liquid includes permitting limited access thereof to the processing liquid in said treating bath while fully containing the rope during its downward movement into said treating bath.

3. A method of wet processing textile material as defined in claim 2 and further characterized in that said returning the rope to said treating bath includes entraining the rope in and wetting the rope with a gravitational flow of a first cycled portion of said processing liquid, thereafter entrainingly impelling the rope with a jetted stream of a second cycled portion of said processing liquid, and then directing the rope and the combined flow of said first and second portions of said processing liquid into said confinement.

* * * * *